US009254689B2

(12) United States Patent
Tokunaga et al.

(10) Patent No.: US 9,254,689 B2
(45) Date of Patent: Feb. 9, 2016

(54) PRINTING APPARATUS AND PRINTING METHOD

(71) Applicant: SEIKO EPSON CORPORATION, Tokyo (JP)

(72) Inventors: Masakazu Tokunaga, Fujimi-machi (JP); Takeshi Tanoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/488,965

(22) Filed: Sep. 17, 2014

(65) Prior Publication Data

US 2015/0097888 A1 Apr. 9, 2015

(30) Foreign Application Priority Data

Oct. 4, 2013 (JP) ..... 2013-208890

(51) Int. Cl.
*B41J 29/38* (2006.01)
*B41J 11/00* (2006.01)

(52) U.S. Cl.
CPC ..... *B41J 11/002* (2013.01)

(58) Field of Classification Search
CPC ..... B41J 2/475; B41J 29/393; B41J 29/38; B41J 11/002
See application file for complete search history.

(56) References Cited

U.S. PATENT DOCUMENTS

| | | | | |
|---|---|---|---|---|
| 2001/0020962 | A1* | 9/2001 | Kanaya et al. | 347/24 |
| 2005/0012778 | A1 | 1/2005 | Nishino et al. | |
| 2005/0062838 | A1* | 3/2005 | Kudou | 347/238 |
| 2006/0012630 | A1* | 1/2006 | Niekawa | 347/37 |
| 2012/0105532 | A1 | 5/2012 | Sanada | |

FOREIGN PATENT DOCUMENTS

| | | |
|---|---|---|
| JP | 2004-167871 | 6/2004 |
| JP | 2004-167918 | 6/2004 |
| JP | 2005-047261 | 2/2005 |
| JP | 2006-026970 | 2/2006 |
| JP | 2012-096407 | 5/2012 |

* cited by examiner

*Primary Examiner* — Shelby Fidler
*Assistant Examiner* — Tracey McMillion
(74) *Attorney, Agent, or Firm* — Workman Nydegger

(57) ABSTRACT

A printing apparatus includes: a nozzle head that has nozzles ejecting ink that is cured by an electromagnetic wave and relatively moves with respect to a printing medium; an applying section that relatively moves together with the nozzle head, and applies the electromagnetic wave; and a control section that controls intensity of the electromagnetic wave, in which a first intensity of the electromagnetic wave in a region in which the applying section and the printing medium face each other and that is a constant speed region in which a speed of the relative movement is constant is greater than a second intensity of the electromagnetic wave in regions in which the applying section and the printing medium do not face each other in at least a part thereof and that are acceleration and deceleration regions in which the speed of the relative movement is not constant.

8 Claims, 10 Drawing Sheets

PRINTING APPARATUS AND PRINTING METHOD

BACKGROUND

1. Technical Field

The present invention relates to a printing apparatus and a printing method.

2. Related Art

In the related art, an ink jet printer performing print by using ink that is cured by applying an electromagnetic wave such as ultraviolet rays (hereinafter, simply referred to as "ink") is known. In a technology disclosed in JP-A-2012-96407, in order to cure the ink, an applying device is provided for applying the electromagnetic wave on both ends of a print head ejecting the ink and on a downstream side in a transportation direction of a printing medium. An inkjet printer in JP-A-2004-167918.

If the electromagnetic wave is applied on a region outside the printing medium, there is concern that the electromagnetic wave is reflected to an unexpected portion such as a nozzle surface of the print head. For example, if the electromagnetic wave is incident on the nozzle surface of the print head, there is concern that a nozzle may be clogged by curing the ink inside the nozzle. Thus, in the technology disclosed in JP-A-2012-96407, the applying device is controlled by dividing into a plurality of units in a moving direction of the print head and the applying device is controlled to be turned on when the unit of the applying device is in a drawing region by every unit, and the applying device is controlled to be turned off when the unit of the applying device is on outside of the drawing region.

However, if the control of turning on and off is performed by unit, there is a problem that a control system becomes complicated. Furthermore, if the applying device is turned from off to on, it takes time until intensity of the electromagnetic wave reaches a target value. An integrated amount of the applied electromagnetic wave is decreased and, as a result, printing unevenness may occur in an end portion of the drawing region.

Furthermore, there is a method in which a shutter is provided in the applying device and the electromagnetic wave is controlled by opening and closing the shutter. However, the method is undesirable because it is necessary for the shutter or a driving mechanism of the shutter to be mounted on a carriage on which the print head or the applying device is mounted, and a weight of the carriage is increased. In addition, in the printing apparatus, it is desired to achieve miniaturization, low cost, low power consumption, resource saving, ease of manufacturing, improvement of usability, long life, improvement of safety during use, and the like.

SUMMARY

The invention can be realized in the following forms or application examples.

According to an aspect of the invention, there is provided a recording apparatus. The recording apparatus includes: a nozzle head that has nozzles ejecting ink that is cured by an electromagnetic wave and relatively moves with respect to a printing medium in at least a main scanning direction; an applying section that relatively moves together with the nozzle head and is positioned at least on a downstream side of the nozzle head in the main scanning direction, and applies the electromagnetic wave; and a control section that controls intensity of the electromagnetic wave, in which a first intensity of the electromagnetic wave in a region in which the applying section and the printing medium face each other and that is a constant speed region in which a speed of the relative movement is constant is greater than a second intensity of the electromagnetic wave in regions in which the applying section and the printing medium do not face each other in at least a part thereof and that are acceleration and deceleration regions in which the speed of the relative movement is not constant. In this case, the electromagnetic wave is not excessively applied to at least a part of the acceleration and the deceleration regions in which the applying section and the printing medium do not face each other. Thus, it is possible to reduce the electromagnetic wave applied to the outside of the printing region.

In the printing apparatus, the acceleration and deceleration regions may have an acceleration region and a deceleration region. In the acceleration region, the intensity in a second relative position in which the applying section is closer to the constant speed region than in a first relative position may be greater than intensity in the first relative position. In the deceleration region, the intensity in a fourth relative position in which the applying section is farther from the constant speed region than in a third relative position may be less than intensity in the third relative position. In this case, it is possible to suppress unevenness of an amount of the applied electromagnetic wave in the acceleration and deceleration regions.

In the printing apparatus, an integrated amount of the electromagnetic wave applied per unit area in the acceleration and deceleration regions may be equal to an integrated amount of the electromagnetic wave applied per unit area in the constant speed region. In this case, it is possible to control an integrated amount of the applied electromagnetic wave by control of the intensity.

In the printing apparatus, the intensity may be greater than 0 in the acceleration and deceleration regions. In this case, it is possible to reduce a time until the intensity of the electromagnetic wave reaches a target value compared to in a case where the electromagnetic wave is controlled by two steps of on/off. Thus, specifically, it is possible to reduce the integrated amount of the applied electromagnetic wave in an end portion of a drawing region.

In the printing apparatus, each applying section may be positioned on opposite sides with respect to the nozzle head in the main scanning direction. In this case, it is possible to perform the main scanning with respect to the printing medium in both directions.

The invention can be realized by various forms in addition to the printing apparatus. For example, the invention can be realized by forms such as a printing method, a computer program for realizing the method, or a recording medium that is not temporary and in which the computer program is recorded.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment

A1. Entire Configuration

Figure 1:
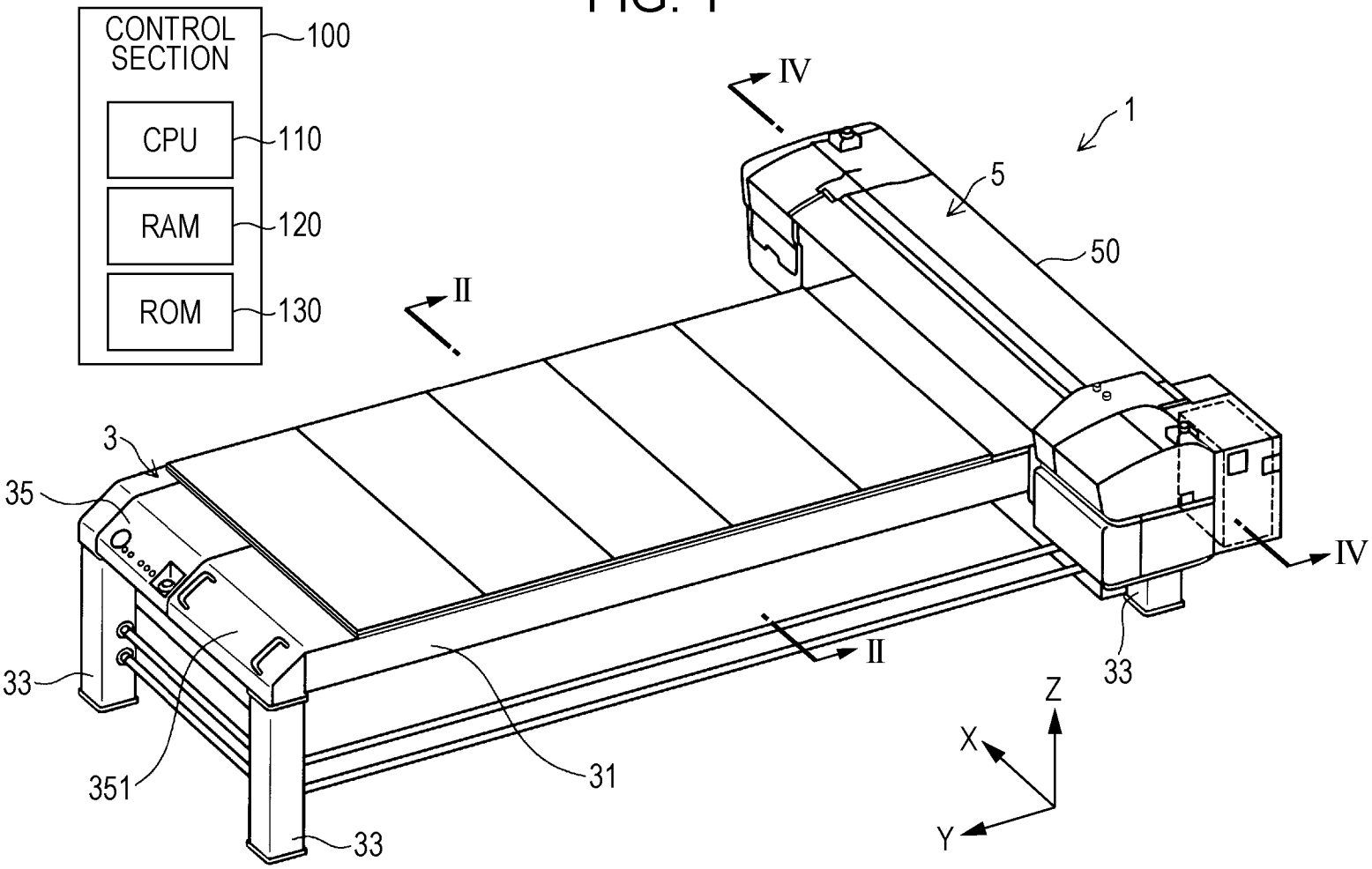
FIG. 1 is a view illustrating a configuration of a printer of an embodiment.

FIG. 1 is a view illustrating a configuration of a printer 1 in an embodiment. First, for ease of description, XYZ axes orthogonal to each other are illustrated in FIG. 1. The same is applied to the following drawings. Hereinafter, an X axis direction is also referred to as a main scanning direction, a Y axis direction is also referred to as a sub-scanning direction, and a Z axis direction is also referred to as a vertical direction.

The printer 1 includes a print processing section 5, a support stage 3, an operation panel 35, an opening/closing door 351, leg sections 33, and a control section 100. The printer 1 of the embodiment is an ink jet printer that is one of liquid ejecting apparatuses ejecting liquid. The printer 1 forms ink documents on a printing medium by ejecting ink as the liquid, thereby recording characters, figures, images, and the like.

The printer 1 is a so-called flat bed type printer and is a printer that performs printing by ejecting ultraviolet (UV) ink from the print processing section 5 with respect to a printing medium horizontally supported by the support stage 3. The printing medium may include a paper, a film, wood, and the like.

The control section 100 includes a CPU 110 that executes various calculation processes, a RAM 120 that performs temporary storage or reservation of a program or data, and a ROM 130 that stores the program and the like to be executed by the CPU 110. Various functions performed by the control section 100 are realized by operation of the CPU 110 based on the program stored in the ROM 130. Moreover, at least a part of functions performed by the control section 100 may be realized by operation of an electrical circuit included in the control section 100 based on a circuit configuration thereof.

The support stage 3 is a substantially planar portion that is long in the sub-scanning direction (Y axis direction) compared to the main scanning direction (X axis direction). When performing the printing, the printing medium is disposed on the support stage 3. Moreover, in the embodiment, a mounting surface 31 of the support stage 3 coming into contact with the printing medium is provided with a plurality of suction ports (not illustrated) and the suction ports suck and hold the printing medium on the mounting surface.

The leg sections 33 are portions supplying four corners of the support stage 3. Casters may be provided at lower ends (−Z direction) of the leg sections 33. It is possible to easily move the printer 1 by the casters.

The operation panel 35 is a portion from which instructions are received by an operator. The opening/closing door 351 is a portion that is provided for the operator to manually perform maintenance on the print processing section 5. The operator opens the opening/closing door 351 by moving the print processing section 5 directly above (+Z direction) the opening/closing door 351 and may manually perform the maintenance of the inside of the print processing section 5.

Figure 2:
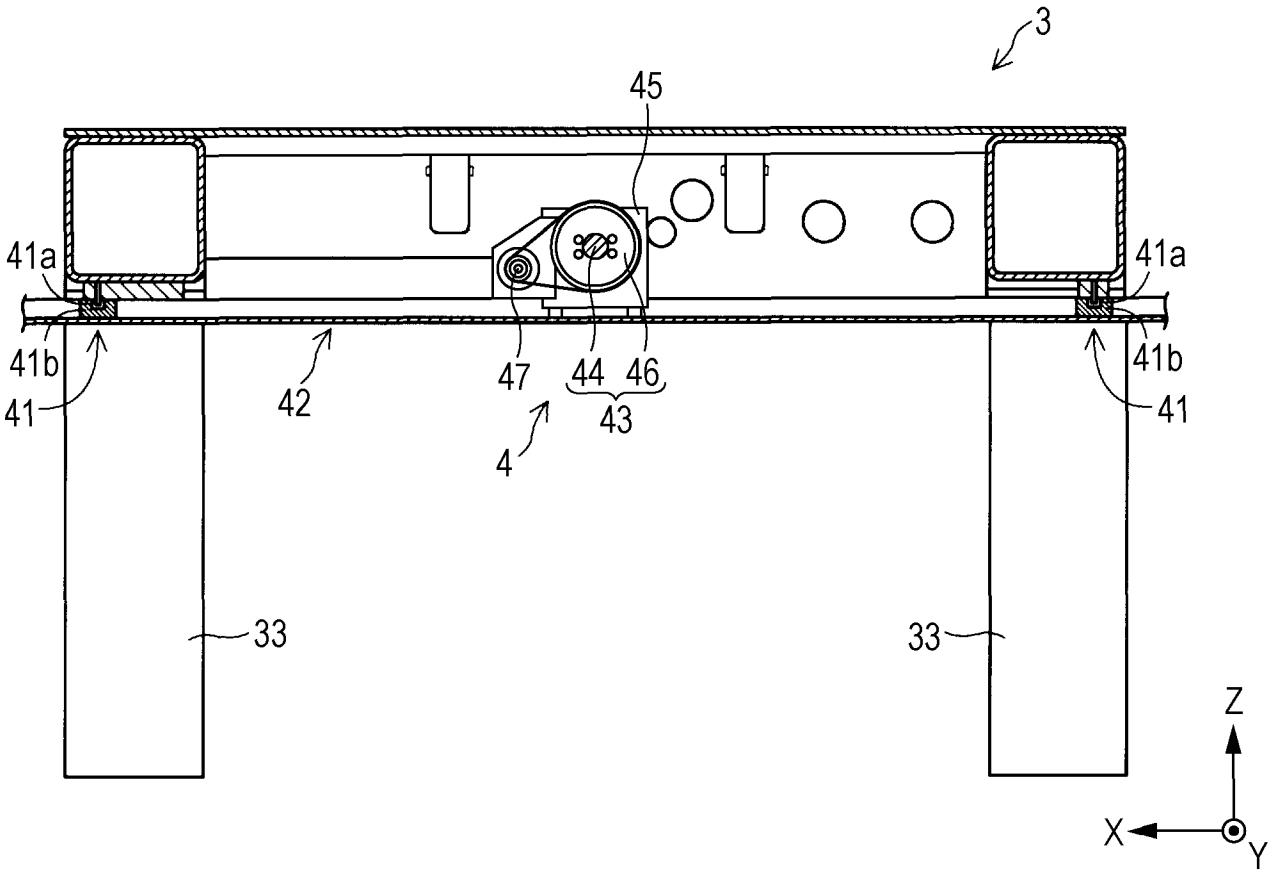
FIG. 2 is an explanatory view illustrating a cross section of a support stage viewed from direction II-II in FIG. 1.

FIG. 2 is an explanatory view illustrating a cross section of the support stage 3 viewed from direction II-II in FIG. 1. The support stage 3 includes a sub-scanning moving section 4 that moves the print processing section 5 in the sub-scanning direction (Y direction). The sub-scanning moving section 4 includes a pair of guide mechanisms 41 that are provided on opposite sides of the support stage 3 in the main scanning direction (X direction), a connection frame 42 that connects the print processing section 5 and the guide mechanisms 41, and a sub-scanning driving mechanism 43 that drives the print processing section 5 along the guide mechanism 41 in the sub-scanning direction (Y direction).

The guide mechanism 41 is configured of LM Guide (registered trademark) in the embodiment. The guide mechanism 41 includes a guide rail 41*a* that extends in the sub-scanning direction (Y direction) and that is fixed on a lower side of the support stage 3, and a slider 41*b* that slides with respect to the guide rail 41*a* in the sub-scanning direction (Y direction). The slider 41*b* is mounted on the print processing section 5 (not illustrated) through the connection frame 42.

The sub-scanning driving mechanism 43 includes a screw shaft 44 that extends in the sub-scanning direction (Y direction) and is fixed to the support stage 3, a nut member 46 that is screwed into the screw shaft 44, a sub-scanning motor 47 that rotates the nut member 46, and a support member 45 which is mounted on the connection frame 42 and on which the nut member 46 is rotatably mounted. The sub-scanning moving section 4 can move the print processing section 5 in the sub-scanning direction (Y direction) together with the connection frame 42 by rotating the nut member 46 by the sub-scanning motor 47.

Figure 3:
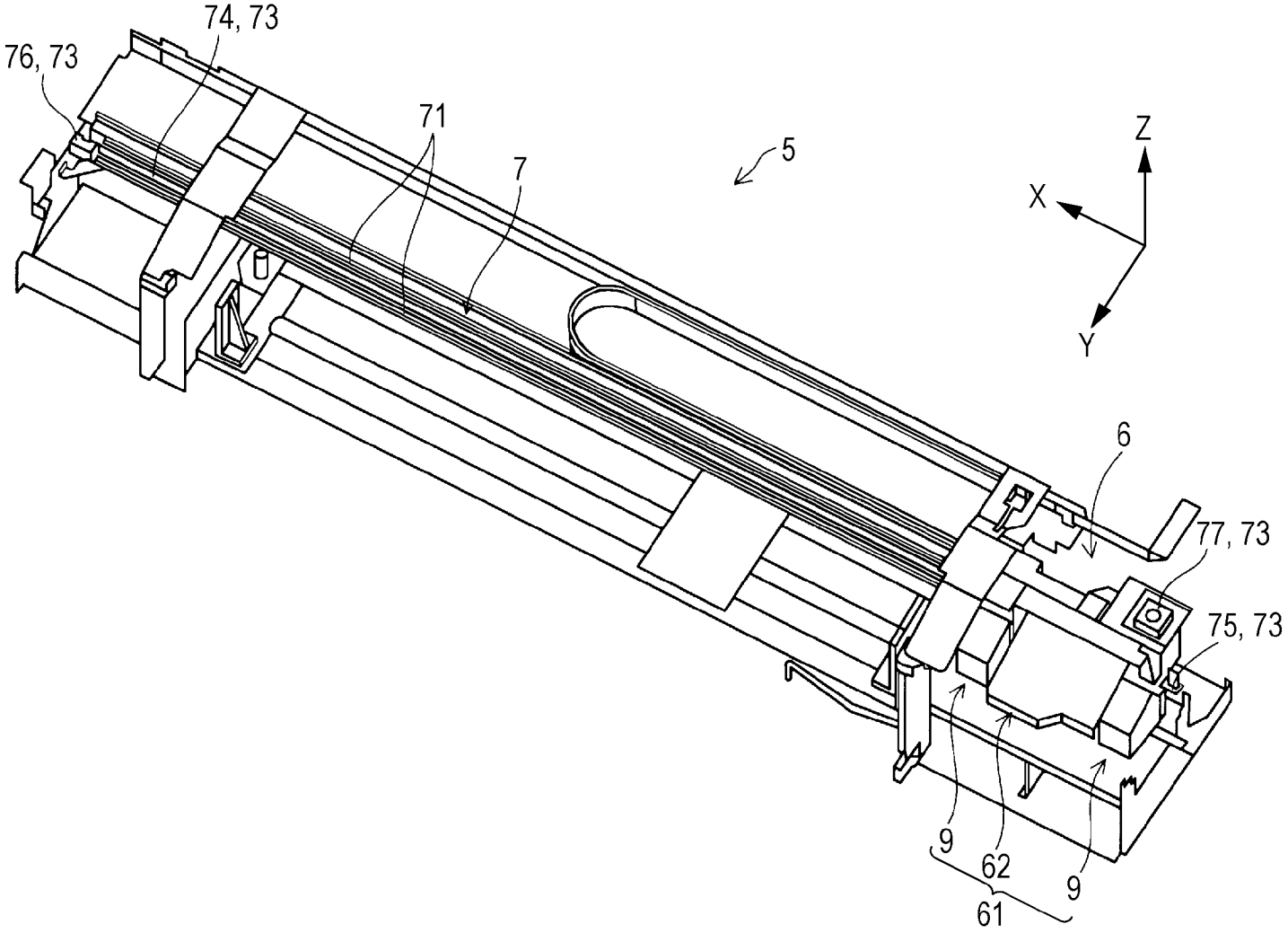
FIG. 3 is an explanatory view illustrating an inside of a printing process section.

FIG. 3 is an explanatory view illustrating the inside of the print processing section 5. The print processing section 5 includes a printing unit 6 on which the print head and the like are mounted, a main scanning moving section 7 that moves the printing unit 6 in the main scanning direction (X direction), and a housing member 50 that accommodates the printing unit 6 and the main scanning moving section 7. Moreover, a state where the housing member 50 (see FIG. 1) is removed is illustrated in FIG. 3.

The main scanning moving section 7 includes a pair of upper and lower guide shafts 71 that supports the printing unit 6 so as to be movable in the main scanning direction (X direction) and a main scanning driving mechanism 73 that is capable of moving the printing unit 6 along the guide shaft 71.

The main scanning driving mechanism 73 includes a timing belt 74 that is extended along the guide shaft 71 in the main scanning direction (X direction), a driving pulley 75 and a driven pulley 76 over which the timing belt 74 is stretched, and a main scanning motor 77 that drives the driving pulley 75. The main scanning moving section 7 can move the printing unit 6 connected to the timing belt 74 in the main scanning direction (X direction) by driving the driving pulley 75 by the main scanning motor 77.

Figure 4:
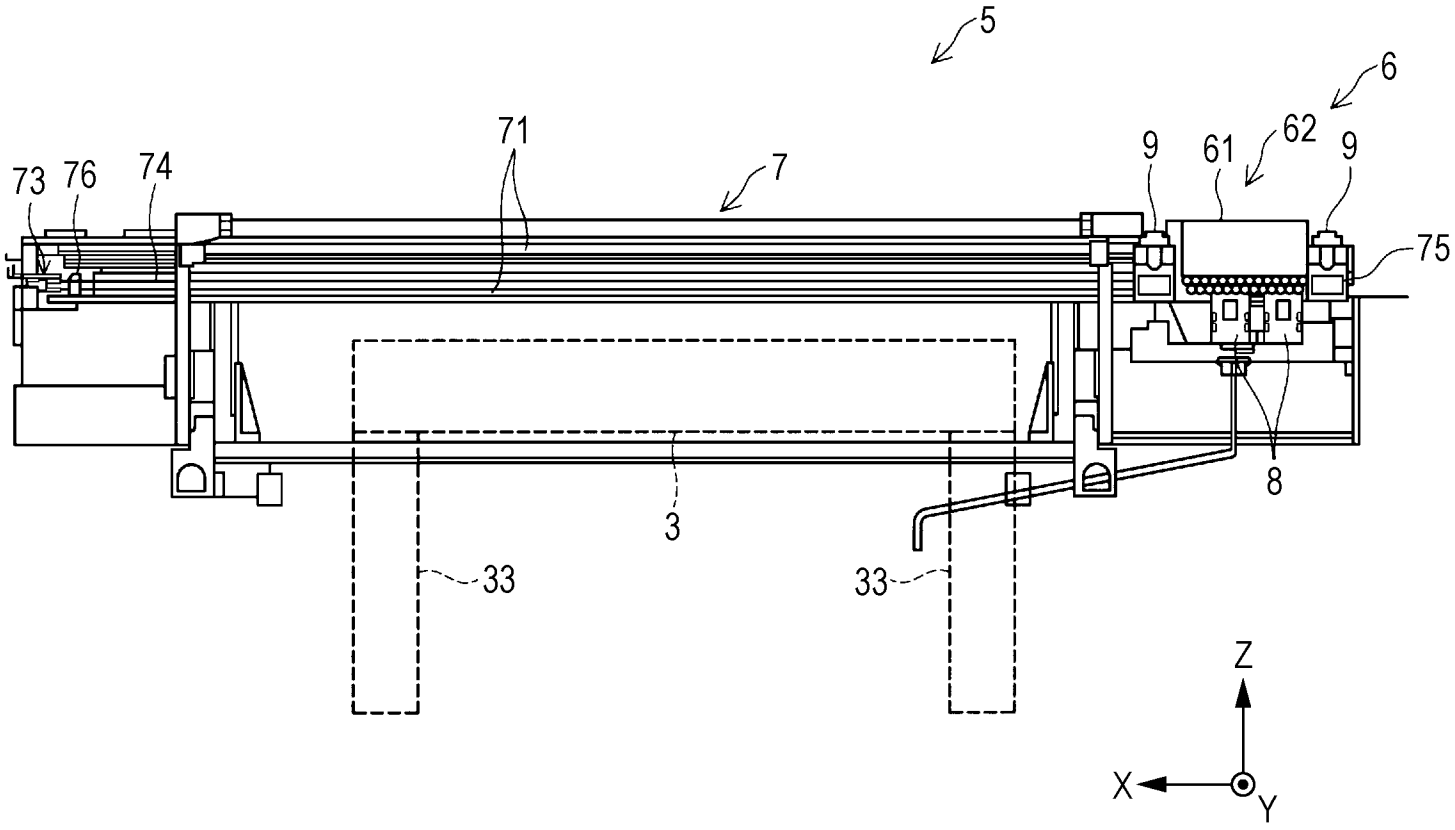
FIG. 4 is an explanatory view illustrating the inside of the print processing section viewed from direction IV-IV in FIG. 1.

FIG. 4 is an explanatory view illustrating the inside of the print processing section 5 viewed from direction IV-IV in FIG. 1. The printing unit 6 included in the print processing section 5 includes a carriage unit 62 on which a nozzle head 8 is mounted on a box-shaped carriage 61 and applying sections 9 that are respectively fixed to opposite sides of the carriage unit 62 in the main scanning direction (X direction). The nozzle head 8 includes nozzles ejecting the UV ink vertically downward (—Y direction).

Figure 5:
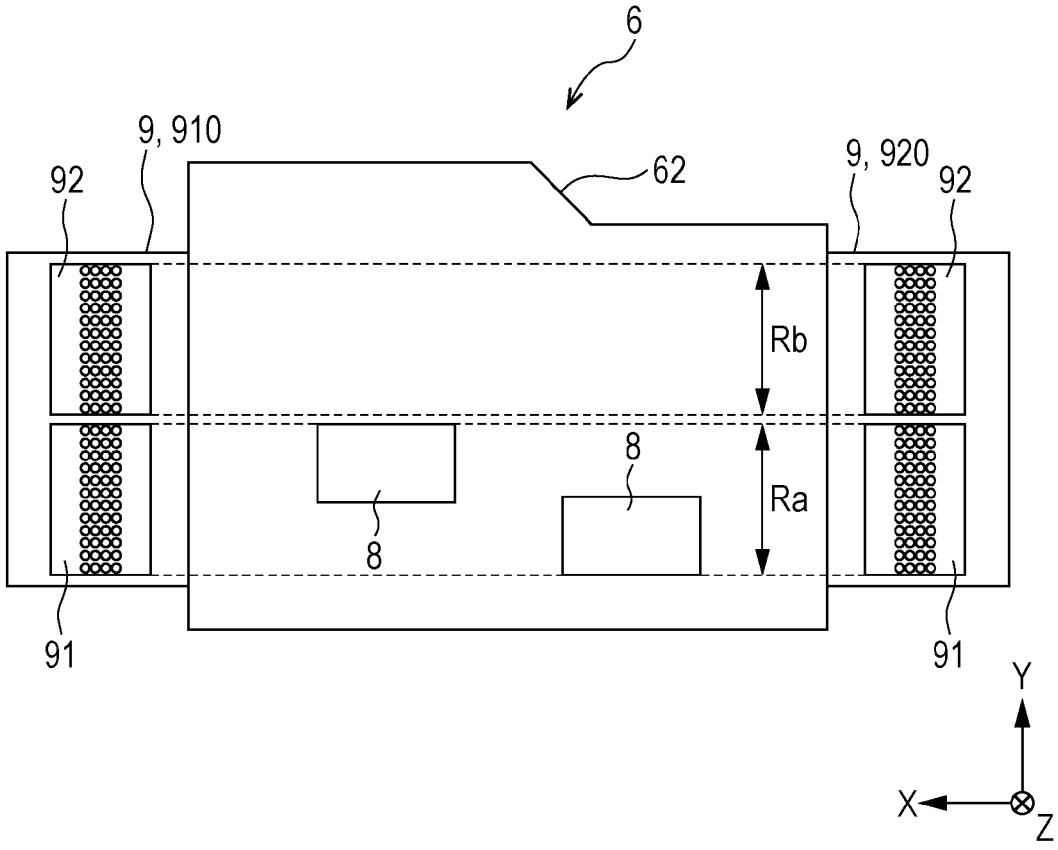
FIG. 5 is an explanatory view illustrating a printing unit viewed from a vertical direction (+Z direction).

FIG. 5 is an explanatory view illustrating the printing unit 6 viewed from a vertically upward direction (+Z direction). A plurality of ink cartridges in which ink having predetermined colors (for example, cyan (C), magenta (M), yellow (Y), black (K)) are respectively stored are mounted on the nozzle head 8 included in the printing unit 6. The ink stored in the ink cartridges are supplied to the nozzle head 8. Furthermore, the nozzle head 8 has a plurality of nozzles ejecting the ink and an actuator (nozzle actuator) provided corresponding to each nozzle. In the embodiment, as the nozzle actuator, a piezoelectric element is used.

The nozzle head 8 faces a region Ra having a protruded width in the sub-scanning direction (Y direction) and prints an image on the region Ra by ejecting the ink onto the region Ra while moving in parallel to the main scanning direction (X direction).

The applying section 9 includes a temporary curing applying section 91 for temporary curing and a real curing applying section 92 for real curing. The temporary curing applying section 91 and the real curing applying section 92 are provided one by one on opposite sides of the nozzle head 8 in the main scanning direction (X direction). The applying section 9 provided on the +X direction side of the carriage unit 62 is referred to as a right side applying section 910 and the applying section 9 provided on the −X direction side of the carriage unit 62 is referred to as a left side applying section 920.

The temporary curing applying section 91 and the real curing applying section 92 are respectively arranged in a row in the sub-scanning direction (Y direction). The temporary curing applying section 91 is disposed so as to irradiate a region overlapping the region Ra and the real curing applying section 92 is disposed further on a downstream side than the temporary curing applying section 91 in the sub-scanning direction (Y direction). Moreover, a region to which the temporary curing applying section 91 in the sub-scanning direction (Y direction) is referred to as a region Rb.

The real curing applying section 92 and the temporary curing applying section 91 are arranged as described above and thereby, first, ultraviolet rays having irradiation intensity weaker than that of the real curing applying section 92 are applied from the temporary curing applying section 91 positioned on the downstream side of the nozzle head 8 in the main scanning direction (X direction) to the ink ejected on the printing medium by the nozzle head 8. The ink wet spreading on the printing medium is sufficiently slowly cured (temporarily cured) by the applying compared to a case where the ultraviolet rays are not applied. Thereafter, when the ink belongs the region Rb by movement of the printing unit 6 to the sub-scanning direction (Y direction), the ultraviolet rays having the irradiation intensity stronger than that of the temporary curing applying section 91 are applied from the real curing applying section 92 to the ink. The ink is cured (really cured) by the applying to an extent that wet-spreading of the ink is stopped on the printing medium.

In the embodiment, as a light source of the temporary curing applying section 91 and the real curing applying section 92, a Light Emitting Diode (LED) is used. For example, the light source of the temporary curing applying section 91 and the real curing applying section 92 may use a metal halide lamp if the light source applies the ultraviolet rays. A method of applying the ultraviolet rays by the applying section 9 is described below.

A2. First Applying Form

Figure 6:
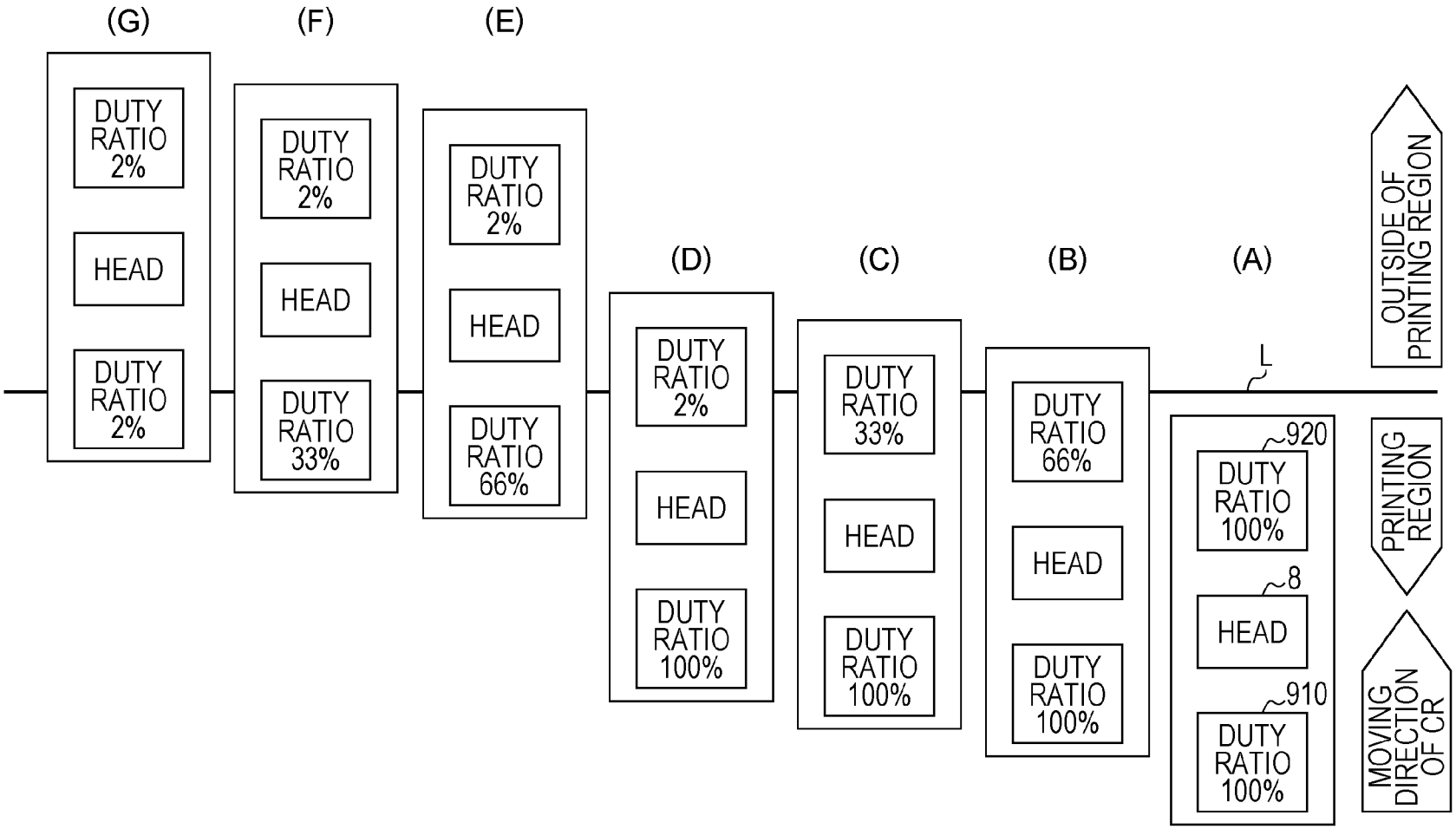
FIG. 6 is an explanatory view illustrating an applying method of an applying section in a first applying form.

FIG. 6 is an explanatory view illustrating the applying method of the applying section 9 in the first applying form. The carriage unit 62 of FIG. 6 is in a state where the carriage unit 62 is viewed from a rear side of the sheet surface in FIG. 5. Moreover, in the first applying form, the control section 100 controls the intensity of the ultraviolet rays by changing a duty ratio for the applying section 9. The control section 100 uses pulse width modulation for changing the duty ratio.

A boundary line L is a boundary line dividing a printing region and the outside of the printing region. Moreover, the printing region is referred to as a region in which the printing medium is mounted on the support stage 3. In the embodiment, the control section 100 determines whether or not it is the printing region based on the size of the printing medium. Moreover, the control section 100 may determine whether or not it is the printing region by providing a camera in the carriage unit 62. In FIG. 6, the applying method of the applying section 9 is described when the printing unit 6 moves from the right side to the left side of the sheet surface.

In (A) of FIG. 6, the right side applying section 910 and the left side applying section 920 exist in the printing region. In this case, the control section 100 controls the duty ratios of the right side applying section 910 and the left side applying section 920 to be respectively 100%.

In (B) of FIG. 6, the right side applying section 910 exists in the printing region but a part of the left side applying section 920 exists on the outside of the printing region. In this case, the control section 100 controls the duty ratio of the right side applying section 910 to be 100% and the duty ratio of the left side applying section 920 to be 66%. Moreover, the reason that the duty ratio of the left side applying section 920 is 66% is that two-thirds of the left side applying section 920 exists in the printing region. In the applying form, the duty ratio is determined by the control section 100 according to an existence ratio of the applying section 9 in the printing region.

In (C) of FIG. 6, most of the left side applying section 920 exists on the outside of the printing region. In contrast, the right side applying section 910 exists in the printing region. In this case, the control section 100 controls the duty ratio of the right side applying section 910 to be 100% and the duty ratio of the left side applying section 920 to be 33%. Similar to in the case of (B) of FIG. 6, the reason that the duty ratio of the left side applying section 920 is 33% is that one-third of the left side applying section 920 exists in the printing region.

In (D) of FIG. 6, the left side applying section 920 exists on the outside of the printing region. On the other hand, the right side applying section 910 exists in the printing region. In this case, the control section 100 controls the duty ratio of the right side applying section 910 to be 100% and the duty ratio of the left side applying section 920 to be 2%.

Also in (E) to (G) of FIG. 6, similar to the case of the left side applying section 920, the duty ratio is controlled by whether or not the right side applying section 910 exists in the printing region. The control section 100 controls the duty ratio of the right side applying section 910 to be 66% in (E) of FIG. 6 and to be 33% in (F) of FIG. 6, and to be 2% in (G) of FIG. 6. On the other hand, in (E) to (G) of FIG. 6, since the left side applying section 920 exists on the outside of the printing region, the control section 100 controls the duty ratio of the left side applying section 920 to be 2%. Moreover, in FIG. 6, a case where the main scanning is performed from the right side to the left side of the sheet surface is described, but similar control is performed even in a case where the main scanning is performed from the left side to the right side of the sheet surface.

The applying section 9 applies the ultraviolet rays to the outside of the printing region by controlling the applying section 9 as described above, and thereby it is possible to suppress reflection of the ultraviolet rays on an unexpected portion. Furthermore, lower power consumption is achieved by reducing an amount of the wasteful ultraviolet rays applied to the outside of the printing region. Furthermore, it is possible to reduce the time until the intensity of the electromagnetic wave reaches a target value by controlling the duty ratio so as not to be 0%, compared to a case of being controlled by turning on or off. Thus, specifically, it is possible to suppress a decrease in an integrated amount of the applied electromagnetic wave in an end portion of the drawing region. As a result, it is possible to suppress the printing unevenness.

A3. Second Applying Form

Figure 7:
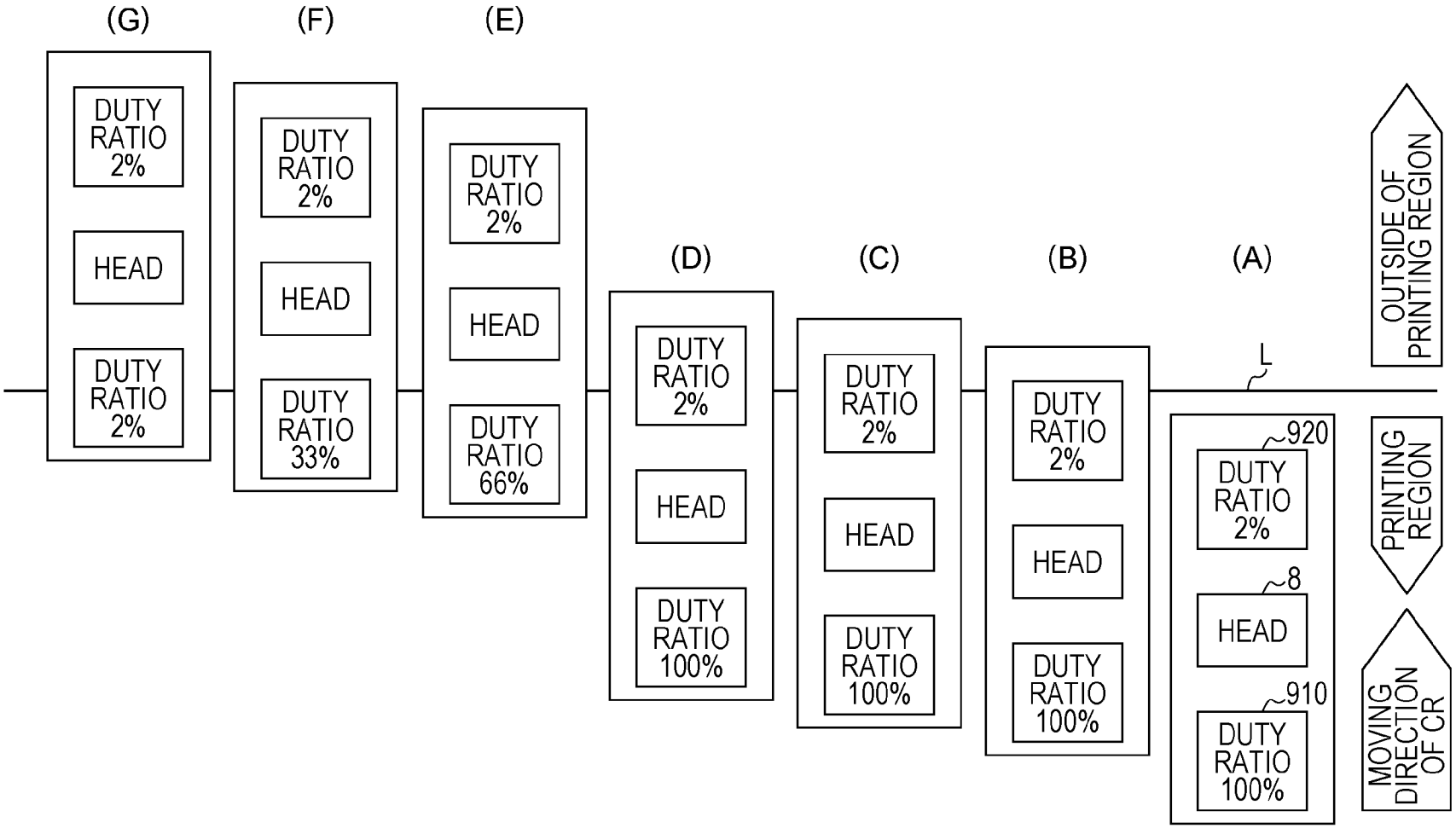
FIG. 7 is an explanatory view illustrating an applying method of an applying section in a second applying form.

FIG. 7 is an explanatory view illustrating an applying method of an applying section 9 in a second applying form. The second applying form is the same as the first applying form other than that the duty ratio of the applying section 9 on an upstream side of the carriage unit 62 is set to be 2%. Similar to FIG. 6, in FIG. 7, the applying method of the applying section 9 when the printing unit 6 moves from the right side to the left side of the sheet surface is described.

In FIG. 7, a duty ratio of a left side applying section 920 on the downstream side of the carriage unit 62 is set to be 2% by the control section 100. On the other hand, the control section 100 controls the duty ratio of the right side applying section 910 similarly to the case (first applying form) of FIG. 6.

It is possible to efficiently apply the ultraviolet rays to the ink ejected from the nozzle head 8 by controlling the applying section 9 as described above. Furthermore, it is possible to suppress the power consumption compared to the case where the duty ratio is 100%.

A4. Third Applying Form

Figure 8:
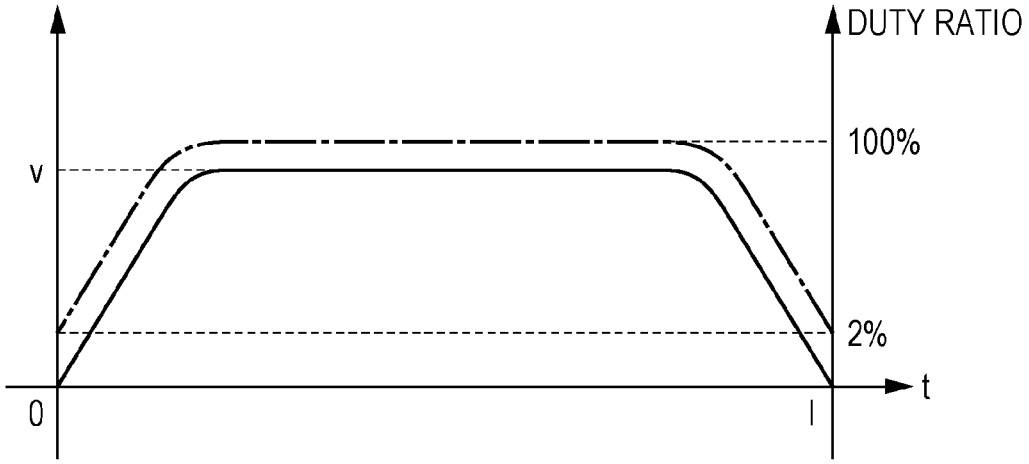
FIG. 8 is an explanatory view illustrating an applying method of an applying section in a third applying form.

FIG. 8 is an explanatory view illustrating an applying method of an applying section 9 in a third applying form. The third applying form is the same as the first applying form other than that control of the duty ratio is correlated with a moving speed of a printing unit 6. In FIG. 8, a horizontal axis represents a time axis and a vertical axis represents the speed at which the applying section 9 moves relative to the printing medium and the duty ratio of the applying section 9. A one-dot chain line represents the duty ratio and a solid line represents the speed. In the embodiment, the control section 100 calculates the speed at which the applying section 9 moves relative to the printing medium by a rotational speed of the main scanning motor 77.

In FIG. 8, a time t is set as 0 when the printing unit 6 is at the left end of the support stage 3 and the time t is set as 1 when the printing unit 6 is at the right end of the support stage 3. In the embodiment, when the speed is 0, the duty ratio of the applying section 9 is 2% and when the speed is constant, the duty ratio of the applying section 9 is 100%. The speed at which the applying section 9 moves relative to the printing medium includes a stage of acceleration, a stage of a constant speed (vm/s), and a stage of deceleration. A region at the stage of the constant speed is referred to as a constant speed region, a region at the stage of the acceleration at a speed slower than the speed at the constant speed region is referred to as an acceleration region, and a region at the stage of the deceleration at a speed slower than the speed at the constant speed region is referred to as a deceleration region.

In the constant speed region, the applying section 9 and the printing medium face each other. Furthermore, at least a part of the acceleration and deceleration regions including the acceleration region and the deceleration region, the applying section 9 and the printing medium do not face each other. Moreover, the reason that the applying section 9 and the printing medium do not face each other in at least a part of the acceleration and deceleration regions is to apply the ultraviolet rays even in the end portion of the printing medium.

When the intensity of the electromagnetic wave in the constant speed region is a first intensity and the intensity of the electromagnetic wave in the acceleration and deceleration regions is a second intensity, as illustrated in FIG. 8, the first intensity is greater than second intensity. Thus, in at least a part of the acceleration and deceleration regions in which the applying section 9 and the printing medium do not face each other, the electromagnetic wave is not excessively applied. Thus, it is possible to suppress the reflection of the ultraviolet rays on an unexpected portion. Furthermore, lower power consumption is achieved by reducing an amount of the wasteful ultraviolet rays applied to the outside of the printing region.

In the acceleration region, when a first relative position and a second relative position in which the applying section 9 is nearer to the constant speed region than in first relative position are assumed, and the intensity of the ultraviolet rays in the second relative position is greater than that in the first relative position. Furthermore, in the deceleration region, when a third relative position and a fourth relative position in which the applying section 9 is farther from the constant speed region than in third relative position are assumed, and the intensity of the ultraviolet rays in the fourth relative position is less than that in the third relative position. Thus, it is possible to suppress the unevenness of the amount of applied ultraviolet rays in the acceleration and deceleration regions.

An integrated amount of the electromagnetic wave applied per unit area in the acceleration and deceleration regions is equal to an integrated amount of the electromagnetic wave applied per unit area in the constant speed region. Thus, a constant electromagnetic wave is applied to the ink ejected onto the printing medium regardless of the position. In this case, it is possible to control an integrated amount of the applied electromagnetic wave by control of the intensity.

A5. Fourth Applying Form

Figure 9:
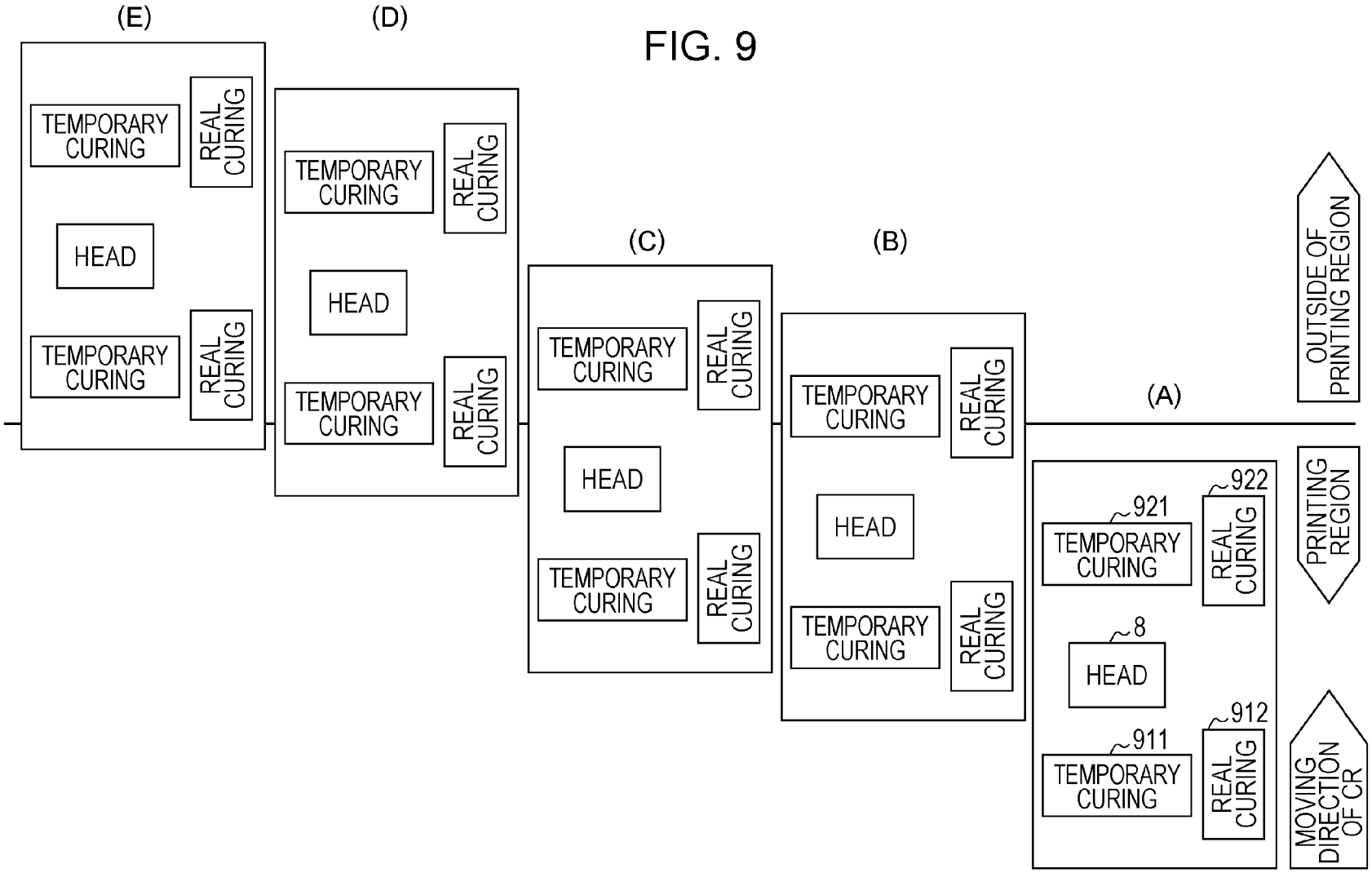
FIG. 9 is an explanatory view illustrating an applying method of an applying section in a fourth applying form.

FIG. 9 is an explanatory view illustrating an applying method of an applying section 9 in a fourth applying form. The fourth applying form is the same as the first applying form other than that control of a temporary curing applying section 91 and a real curing applying section 92 is individually performed. In FIG. 9, widths of the temporary curing applying section 91 and the real curing applying section 92 are different from each other in the main scanning direction (X direction) and the width of the real curing applying section 92 is wider than that of the temporary curing applying section 91. Moreover, in the embodiment, the temporary curing applying section 91 in a right side applying section 910 is referred to as an applying section 911, the real curing applying section 92 in the right side applying section 910 is referred to as an applying section 912, the temporary curing applying section 91 in a left side applying section 920 is referred to as an applying section 921, and the real curing applying section 92 in the left side applying section 920 is referred to as an applying section 922.

In (A) of FIG. 9, all of the applying section 9 exists in the printing region. Thus, the control section 100 controls the duty ratio of the applying section 9 (applying sections 911, 912, 921, and 922) to be 100%.

In (B) of FIG. 9, a part of the applying sections 911, 912, and 922 exist in the printing region, but the applying section 921 exists on the outside of the printing region. In this case, the control section 100 controls the duty ratios of the applying sections 911, 912, and 922 to be 100% and the duty ratio of the applying section 921 to be 0%.

In (C) of FIG. 9, the applying sections 911 and 912 exist in the printing region, but the applying sections 921 and 922 exist on the outside of the printing region. In this case, the control section 100 controls the duty ratios of the applying sections 911 and 912 to be 100% and the duty ratios of the applying sections 921 and 922 to be 0%.

In (D) of FIG. 9, using a similar control method, the control section 100 controls the duty ratio of the applying section 912 to be 100% and the duty ratios of the applying sections 911, 921, and 922 to be 0%. In (E) of FIG. 9, the control section 100 controls the duty ratio of the applying section 9 (applying sections 911, 912, 921, and 922) to be 0%.

It is possible to suppress the reflection of the ultraviolet rays on an unexpected portion by individually controlling the temporary curing applying section 91 and the real curing applying section 92 without complicating the control system. Furthermore, lower power consumption is achieved by reducing an amount of the wasteful ultraviolet rays applied to the outside of the printing region.

A6. Fifth Applying Form

Figure 10:
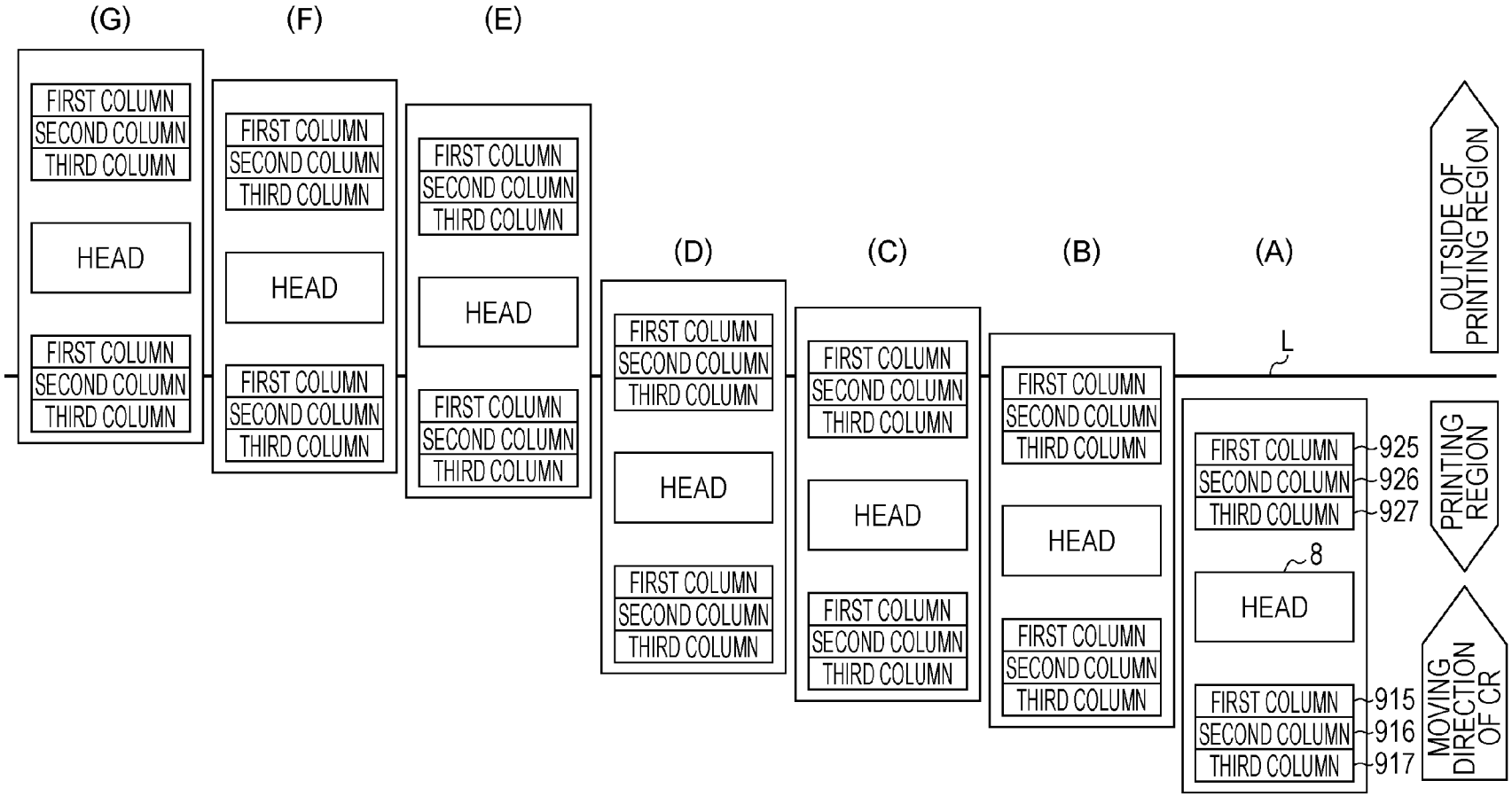
FIG. 10 is an explanatory view illustrating an applying method of an applying section in a fifth applying form.

FIG. 10 is an explanatory view illustrating an applying method of an applying section 9 in a fifth applying form. The applying form is the same as the first applying form other than that a duty ratio of the applying section 9 is controlled for each column of light sources in the main scanning direction (X direction).

In order from the left side in the drawing, a first column of the light source of a right side applying section 910 is referred to as an applying section 915, a second column is referred to as an applying section 916, and a third column is referred to as an applying section 917, and a first column of the light source of a left side applying section 920 is referred to as an applying section 925, a second column is referred to as an applying section 926, and a third column is referred to as an applying section 927.

In (A) of FIG. 10, all of the applying section 9 exists in the printing region. Thus, the control section 100 controls the duty ratio of the applying section 9 (applying sections 915, 916, 917, 925, 926, and 927) to be 100%.

In (B) of FIG. 10, the applying sections other than applying section 925 exist in the printing region, but the applying section 925 exists on the outside of the printing region. In this case, the control section 100 controls the duty ratios of the applying sections other than applying section 925 to be 100% and the duty ratio of the applying section 925 to be 2%.

In (C) to (G) of FIG. 10, using a similar control method, the control section 100 controls the duty ratios of the applying sections existing in the printing region to be 100% and the duty ratios of the applying sections existing on the outside of the printing region to be 2%. Thus, it is possible to suppress the reflection of the ultraviolet rays on an unexpected portion by the applying section 9 applying ultraviolet rays to the outside of the printing region. Furthermore, lower power consumption is achieved by reducing an amount of the wasteful ultraviolet rays applied to the outside of the printing region.

B. Modification Example

Moreover, the invention is not limited to the above embodiments and it is possible to be implemented in various embodiments within a scope not departing from the scope and spirit thereof and, for example, it is possible to be implemented in the following modifications.

B1. Modification Example 1

In the embodiment, the upper limit of a duty ratio is 100%. However, the invention is not limited to the embodiment. The upper limit of the duty ratio may be set to be a value (for example, 80% or 70%) lower than 100%. Thus, even if an output of the applying section 9 is reduced according to the aging of the applying section 9, it is possible to perform adjustment of the output by the duty ratio.

B2. Modification Example 2

In the embodiment, a duty ratio is controlled by whether or not an applying section 9 is in the printing region other than third applying form. However, the invention is not limited to the embodiment. That is, in the embodiment other than third applying form, the control of the duty ratio may be limited by a speed of a printing unit 6. Thus, it is possible to combine the advantages of each applying form. Furthermore, as in the second applying form, a form in which only the applying section 9 on a downstream side of a nozzle head 8 is controlled may be combined with other applying forms.

B3. Modification Example 3

In the embodiment, a temporary curing applying section 91 and a real curing applying section 92 are provided one by one on opposite sides of a carriage unit 62 in a main scanning direction (X direction). It is possible to perform the main scanning in the +X direction and the −X direction by providing the applying sections as described above. However, the invention is not limited to the embodiment. When performing the main scanning only in one direction of the +X direction or the −X direction, the temporary curing applying section 91 and the real curing applying section 92 may be provided on the downstream side of the carriage unit 62 in the main scanning direction.

B4. Modification Example 4

In the embodiment, when an applying section 9 does not exist in the printing medium, a duty ratio of the applying section 9 is controlled to be 2%. However, the invention is not limited to the embodiment. The duty ratio when the applying section 9 does not exist in the printing medium may be less than the duty ratio when the applying section 9 exists in the printing medium and the duty ratio may be 0%, that is, the irradiation may be turned off.

Furthermore, in the embodiment, the duty ratio is controlled depending on an existence ratio of the applying section 9 in the printing medium or the speed of the printing unit 6. However, the invention is not limited to the embodiment. For example, a control method of the duty ratio may be controlled in multiple stages depending on the existence ratio of the applying section 9 in the printing region.

The invention is not limited to the above embodiments and the modification examples may be implemented in various configurations in a range without departing from the spirit thereof. For example, in order to solve a part of or all of the above problems, or achieve a part of or all of the above effects, technical characteristics in the embodiments and the modification examples corresponding to the technical characteristics in each embodiment described in the column of the summary of the invention may be appropriately replaced or combined. Furthermore, the technical characteristics may be appropriately removed if the technical characteristics are not described as essential to the specification.

The entire disclosure of Japanese Patent Application No. 2013-208890, filed Oct. 4, 2013 is expressly incorporated by reference herein.

What is claimed is:

1. A printing apparatus comprising:

a nozzle head that has nozzles ejecting ink that is cured by an electromagnetic wave and relatively moves with respect to a printing medium in at least a main scanning direction;

an applying section that relatively moves together with the nozzle head and is positioned on a downstream side of the nozzle head in the main scanning direction, and applies the electromagnetic wave; and a control section that controls intensity of the electromagnetic wave, wherein the applying section relatively moves in a constant speed region and a not constant speed region; and wherein in the not speed constant region, the intensity of electromagnetic wave at a first relative position is smaller than the intensity of electromagnetic wave at a second relative position that is between the first relative position and the constant speed region.

2. The printing apparatus according to claim 1, wherein an integrated amount of the electromagnetic wave applied per unit area in the not constant speed region is equal to an integrated amount of the electromagnetic wave applied per unit area in the constant speed region.

3. The printing apparatus according to claim 1, wherein the intensity is greater than 0 in the not constant speed region.

4. The printing apparatus according to claim 1, wherein the applying section includes a plurality of applying sections, wherein each applying section of the plurality of applying sections is positioned on opposite sides with respect to the nozzle head in the main scanning direction.

5. The printing apparatus according to claim 1, wherein the in the constant speed region, the applying section and the printing medium face each other and in the not constant speed region, the applying section and the printing medium do not face each other in at least a part thereof.

6. The printing apparatus according to claim 1, wherein the intensity of the electromagnetic wave in the constant speed region is greater than the intensity of the electromagnetic wave in the not constant speed region.

7. The printing apparatus according to claim 5, wherein the not constant speed region is an acceleration region or a deceleration region.

8. A printing method performing printing by using a printing apparatus including a nozzle head that has nozzles ejecting ink that is cured by an electromagnetic wave and relatively moves with respect to a printing medium in at least a main scanning direction; and an applying section that relatively moves together with the nozzle head and is positioned on a downstream side of the nozzle head in the main scanning direction, and applies the electromagnetic wave, wherein the applying section relatively moves in a constant speed region and a not constant speed region, the method comprising:

applying the electromagnetic wave at a first relative position in the not constant speed region at a first intensity; and applying the electromagnetic wave at a second relative position in the not constant speed region that is between the first relative position and the constant speed region at a second intensity, wherein the first intensity is smaller than the second intensity.

* * * * *